United States Patent [19]

Mitsuhashi et al.

[11] Patent Number: 4,766,271

[45] Date of Patent: Aug. 23, 1988

[54] ELASTOMER-MADE PUSH BUTTON SWITCH COVERING MEMBER

[75] Inventors: Masayuki Mitsuhashi; Naoto Komine; Takao Shimizu, all of Saitama, Japan

[73] Assignee: Shin-Etsu Polymer Co., Ltd., Tokyo, Japan

[21] Appl. No.: 65,921

[22] Filed: Jun. 24, 1987

Related U.S. Application Data

[63] Continuation-in-part of Ser. No. 806,443, Dec. 9, 1985.

[30] Foreign Application Priority Data

Dec. 12, 1984 [JP] Japan ..... 59-262605

[51] Int. Cl.[4] ..... H01H 3/12

[52] U.S. Cl. ..... 200/159 B; 200/5 A

[58] Field of Search ..... 200/159 B, 5 A

[56] References Cited

U.S. PATENT DOCUMENTS

| | | | |
|---|---|---|---|
| 4,289,943 | 9/1981 | Sado | 200/160 |
| 4,354,068 | 10/1982 | Sobol, III | 200/159 B |
| 4,390,765 | 6/1983 | Sado et al. | 200/159 B |
| 4,471,176 | 9/1984 | Inaba | 200/159 B |
| 4,532,575 | 7/1985 | Suwa | 200/159 B |

FOREIGN PATENT DOCUMENTS

| | | | |
|---|---|---|---|
| 2058462 | 4/1981 | United Kingdom | 200/159 B |
| 2062965 | 5/1981 | United Kingdom | 200/159 B |
| 2078009 | 12/1981 | United Kingdom | 200/159 B |

*Primary Examiner*—Henry J. Recla
*Assistant Examiner*—Linda J. Sholl
*Attorney, Agent, or Firm*—Hopgood, Calimafde, Kalil, Blaustein & Judlowe

[57] ABSTRACT

The invention provides an elastomer-made push button switch covering member having a dome-like configuration integrally composed of a base portion, a top portion and a riser portion connecting the base portion and the top portion. By virtue of the specific elastic properties of the elastomer with a Shore D hardness of at least 35 or, preferably, in the range from 35 to 60 and a rebound of at least 40%, the covering member can give the operator's finger tip a very definite and reliable feeling of clicking touch in pushing different from or superior to conventional rubber-made push button switch covering members.

2 Claims, 3 Drawing Sheets

ELASTOMER-MADE PUSH BUTTON SWITCH COVERING MEMBER

CROSS REFERENCE TO RELATED APPLICATIONS

This application is a continuation-in-part of U.S. patent application Ser. No. 806,443, filed Dec. 9, 1985 now abandoned. The disclosure of Ser. No. 806,443 is hereby incorporated by reference.

BACKGROUND OF THE INVENTION

The present invention relates to an elastomer-made push button switch covering member or, more particularly, to an elastomer-made push button switch covering member composed of a base portion, a top portion and a riser portion connecting the base portion and the top portion into a dome-like configuration, of which the switching stroke does not exceed 0.5 mm and the click ratio is at least 30% to ensure high efficiency of switching operation with very reliable and pleasant feeling of touch on the operator's finger tip.

In recent years, flat-panel key board switches are widely used, for example, in various kinds of input switches including remote control switching units. In view of the usually very small switching stroke in such flat-panel keyboard switches, it is essential that the switching operation of the switch can be definitely recognized by pushing the switch with a finger tip. Such a recognition can be obtained in several different ways including light and sound signals although the most preferable and reliable way is practically that the pushing finger tip receives a clearly recognizable feeling of clicking touch from the key top.

Push button switch covering members are sometimes made of a relatively rigid material with an object to prevent deformation and slackening after use for a prolonged period of time so that the switching stroke of a key board switch having such a covering member can rarely be larger than 0.2 to 0.5 mm. When the switching stroke is so small, conventional rubber-made push buttom switches can hardly give the pushing finger tip a definite and reliable feeling of clicking touch which is expressed by the click ratio defined by $(a-d)/a\times 100$ (%), in which a is the pushing load at the peak and d is the pushing load at the moment of clicking in the pushing stroke vs. pushing load diagram.

A solution for the above mentioned problem is obtained by the use of a resilient diaphragm made of a metal such as German silver, phosphor bronze, stainless steel and the like in a downwardly concave configuration as a movable contact member facing the fixed contact points therebelow and coming into contact therewith when pressed down. Such a resilient metal-made diaphragm member can give a considerably good touch of clicking with a click ratio as high as 46.7% by the reversal of the curvature at a certain point in the course of increase of the pushing load. A problem of such a push button switch is the low reliability and durability due to the fatigue of the metal-made diaphragm to fail to regain the original unpressed configuration after a clicking takes place and dust particles entering between the fixed contact point and the diaphragm to cause failure in establishing electric connection therebetween. Moreover, another disadvantage is that the productivity in the assembling works of push button switches of such a metal-made diaphragm type cannot be high enough because each push button switch must contain a metal-made diaphragm inserted between the covering member and the base board with accuracy in position to ensure centering of the pushing load relative to the diaphragm even by setting aside the problem caused by the increased number of the parts to be assembled into a push button switch.

SUMMARY OF THE INVENTION

An object of the present invention is therefore to provide an elastomer-made push button switch covering member free from the above described problems and disadvantages in the conventional push button switches.

The push button switch covering member of the invention is a member having a dome-like configuration as a whole integrally composed of a base portion, a top portion and a riser portion connecting the base portion and the top portion into a dome-like form and made of a rubbery elastomer having a Shore D hardness of at least 35 or, preferably, in the range from 35 to 60 and a rebound of at least 40%, wherein rebound is as defined in Japanese Industrial Standard (JIS) K6301 (1975, Reaffirmed 1978).

DETAILED DESCRIPTION OF THE PREFERRED EMBODIMENTS

Figure 1:
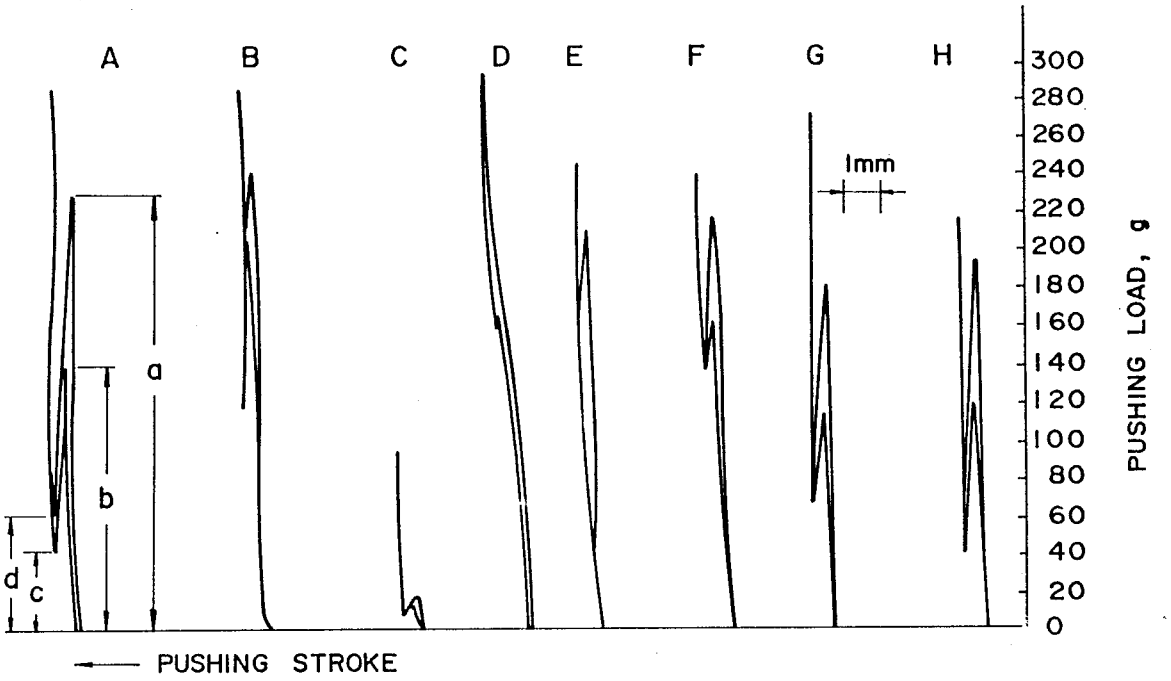
FIG. 1, illustrates pushing strokes vs. pushing load diagrams in various types of push button switches.

In the first place, the problems in the conventional push button switches are described with reference to the accompanying drawing. The diagram A in FIG. 1 shows the pushing stroke vs. pushing load relationship given for the purpose of explanation of the click ratio here implied, in which the height a corresponds to the maximum pushing load in the course of the increase of the pushing stroke before clicking takes place and the height d corresponds to the pushing load at a moment when clicking takes place in the course of the increase of the pushing stroke after the maximum pushing load of a. As is mentioned before, the click ratio in % is given by $(a-d)/a\times 100$ and a better feeling of clicking touch is obtained when the click ratio is sufficiently large.

Figure 7:
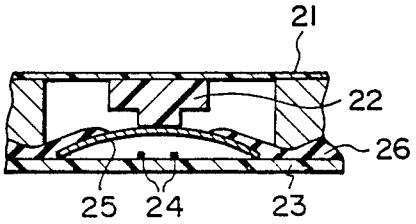
Figure 8:
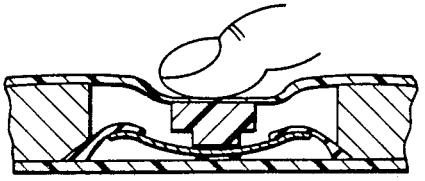

FIG. 7 illustrates a vertical cross sectional view of a conventional diaphragm type push button switch composed of a surface panel sheet 21 bearing a pushing head 22 on the lower surface thereof and mounted on a printed circuit board 23 having a pair of fixed contact points 24 and a metal-made downwardly concave diaphragm 25 having resilience between the pushing head 22 and the circuit board 23 as held by a holder piece 26. When the surface panel sheet 21 is depressed with a finger tip at a position just above the pushing head 22 as is illustrated in FIG. 8, the curvature of the diaphragm 25 is clickingly reversed to give a considerably high click ratio even with a low pushing stroke. The push button switches of this type, however, have various problems and disadvantages as discussed above.

Figure 2:
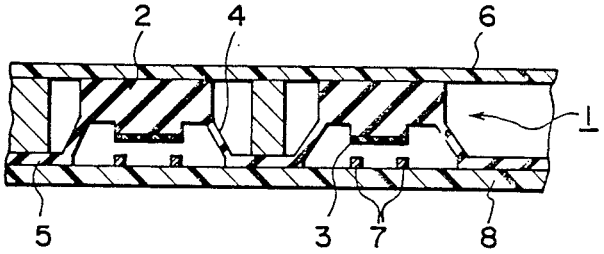
FIGS. 2 to 6 are each a vertical cross sectional view of a push button switch covering member of the invention and FIGS. 7 and 8 are each a vertical cross sectional view of a conventional diaphragm type push button switch either without pushing or as despressed by pushing, respectively.

In contrast to the above described push button switches of the diaphragm type, a push button switch having a typical covering member of the invention illustrated in FIG. 2 has no such a diaphragm. The covering member 1 mounted directly on a printed circuit board 8 having a pair of fixed contact points 7 is integrally composed of a base portion 5 contacting the circuit board 8, a top portion 2 bearing a movable contact point 3 on the lower surface thereof and a relatively thin-walled riser portion 4 connecting the base portion 5 and the top portion 2 into a dome-like configuration. It is usual that the covering member 1 having a plural number of the above described units is covered with a surface panel sheet 6 indicating the pushing positions. It is essential in the invention that the covering member 1 is shaped of a rubbery elastomer having the above specified Shore D hardness and the value of rebound.

Figure 3:
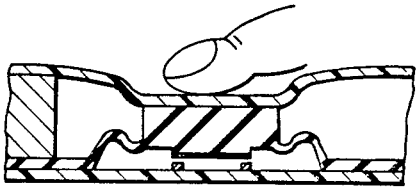

When the top portion 2 of the covering member 1 is pushed down and depressed directly or through the surface panel sheet 6 as is illustrated in FIG. 3, the riser portion 4 is deformed with buckling to bring the movable contact point 3 into contact with the fixed contact points 7 below to connect the fixed contact points 7 electrically. It is essential in this case in order that the operator's finger tip receives a definite and reliable feeling of click switching that the buckling of the riser portion 4 should take place as suddenly as possible and the buckled riser portion 4 exhibits a resilience by virtue of the elastic behavior thereof. Such conditions are satisfied only when the rubbery elastomer of which the covering member 1 is shaped has a Shore D hardness of at least 35 or, preferably, from 35 to 60 and a rebound of at least 40%.

When the covering member 1 illustrated in FIG. 2 is shaped of an elastomer having a Shore D hardness of 40 and a rebound of 62%, for example, the switching operation gives a pushing stroke vs. pushing load diagram as illustrated by the curve H in FIG. 1 from which the click ratio can be calculated to give a value of 72.4%. When the covering member 1 is made of a silicone rubber having a Shore A hardness of 60 corresponding to a Shore D hardness of 20 to 25 and a rebound of about 60%, on the other hand, the pushing operation thereon gives the pushing stroke vs. pushing load diagram C of FIG. 1. Although the click ratio calculated from the diagram C is 60%, the absolute value of clicking is small due to the low peak value of the pushing load as a result of the low hardness of the rubber so that the clicking touch received by the operator's finger tip is not always quite definite and reliable. When the wall thickness of the riser portion 4 in such a silicone rubber-made covering member 1 is increased with an object to have a larger absolute peak value of the pushing load, the click ratio is decreased almost to zero as is calculated from the diagram D in FIG. 1 due to the decreased suddenness of the buckling deformation taking place in the riser portion 4 so that the operator's finger tip receives no feeling of clicking touch.

When the push button switch covering member 1 as illustrated in FIG. 2 is shaped of an elastomer having a Shore D hardness of 35 and a rebound of 39% to give the stroke vs. load diagram E of FIG. 1, the click ratio calculated from the diagram is 20.8% to impart the operator's finger tip with a feeling of clicking touch to some extent though not quite satisfactory without sufficient definiteness and reliableness.

Figure 4:
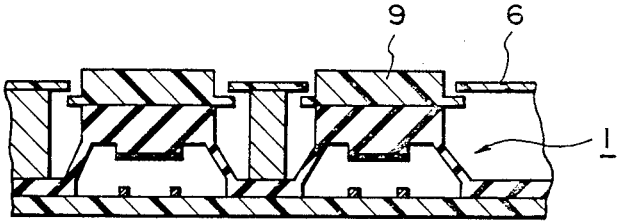
Figure 5:
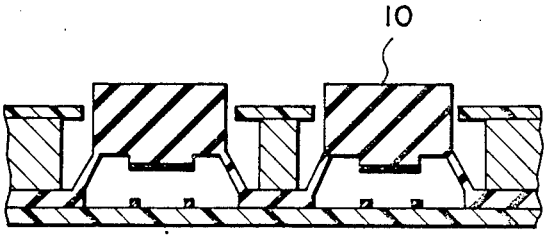

Apart from the typical assemblage illustrated in FIG. 2 with a surface panel sheet 6 covering all over the key board switching panel, it is of course optional that a key top piece 9 made of a relatively rigid material is put on each of the switch units in contact with the top flat 2 of the covering member 1 as is illustrated in FIG. 4. Furthermore, it is optional that, by virtue of the high hardness of the rubbery elastomer of which the covering member 1 is shaped, the top portion and the key top piece are shaped integrally with the same rubbery elastomer as is illustrated in FIG. 5 in the form of an integral top flat 10.

Figure 6:
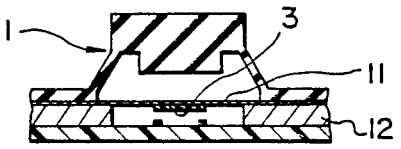

FIG. 6 illustrates another model of the push button switch covering member of the invention which, different from the model illustrated in FIGS. 2 to 5, has no movable contact point on the lower surface of the top flat 2. Instead, a flexible insulating membrane 11 made of, for example, a polyester film, is inserted between the circuit board 8 bearing the fixed contact points 7 thereon and the covering member 1 with a spacer 12 between the circuit board 8 and the flexible membrane 11 and the movable contact point 3 is provided on the lower surface of the flexible membrane 11 by the technique of printing with an electroconductive ink or other suitable means.

The push button switch covering member of the invention can be prepared by compression molding, injecion molding and the like using an elastomer stock having the specified Shore D hardness and rebound. It is of course optional that such an elastomer stock is first shaped into a sheet-like preform which is then shaped into the desired form of the covering member by vacuum forming or pressure forming. The type of the elastomer is not particularly limitative provided that the elastomer has the specified Shore D hardness and rebound. Exemplary of suitable elastomers are polyamide-polyether copolymeric rubbers, polyester-polyether compolymeric rubbers, polyurethnes, polyolefins, styrene-butadiene copolymeric rubbers, fluorocarbon elastomers and the like.

Following is an example to illustrate the push button switch covering member of the invention in more detail.

EXAMPLE

Several push button switch covering members E, F, G and H having a configuration illustrated in FIG. 2 were prepared using several different elastomer stocks having a Shore D hardness of 35 to 46 and a rebound of 44 to 62% including a thermoplastic polyamide-polyether copolymeric elastomer and a thermoplastic polyurethane elastomer. The covering member had dimensions of 6 mm of the diameter of the top flat, 0.5 mm of the overall pushing stroke, 0.08 mm of the wall thickness in the riser portion and 60° of the rising angle of the riser portion relative to the base portion. These covering members were each subjected to the test of the pushing stroke vs. pushing load relationship to give the results shown in Table 1 below and by the diagrams E, F, G and H, respectively, in FIG. 1.

For comparison, further covering members C and D having the same configuration and dimensions as above except that the wall thickness of the riser portion was 0.08 mm or 0.20 mm, respectively, were prepared using a silicone rubber having a Shore D hardness of 20 and a rebound of 65%. The results of the tests for the pushing stroke vs. pushing load relationship performed of these comparative covering members are shown also in Table 1 and by the diagrams C and D, respectively, in FIG. 1.

Further for comparison, a diaphragm type push button switch B as illustrated in FIG. 7 was prepared using a membrane of German silver. The result of the test for the pushing stroke vs. pushing load relationship undertaken of this push button switch B is shown in Table 1 and by the diagram B in FIG. 1.

TABLE 1

| Switch No. | | G | H | F | E | D | C | B |
|---|---|---|---|---|---|---|---|---|
| Rubber | Type*1 | I | I | II | II | III | III | *2 |
| | Hardness, Shore D | 35 | 40 | 46 | 35 | 20 | 20 | — |
| | rebound, % | 65 | 62 | 44 | 39 | 65 | 65 | — |
| Peak load, g | | 180 | 196 | 224 | 212 | 204 | 20 | 244 |
| Feeling of clicking touch | Click ratio, % | 53.3 | 72.4 | 33.0 | 20.8 | 0 | 60 | 46.7 |
| | Organoleptic | Good | Good | Good | Fair | Poor | Poor | Good |

*1I: polyamide-polyether copolymer; II: urethane rubber; III: silicone rubber
*2metal-made diaphragm type

What is claimed is:

1. A push button switch having a push button switch covering member having a dome-like configuration as a whole integrally composed of a base portion, a top portion, and a riser portion connecting the base portion and the top portion in a dome-like form and made of a rubbery elastomer having a Shore D hardness of at least 35 and a rebound of at least 40%;

said push button switch having a click ratio of at least 30% according to the formula $(a-d)/a \times 100$, wherein a is the pushing load at the peak and d is the pushing load at the moment of clicking, at a switching stroke of about 0.5 mm or less.

2. The push button switch covering member as claimed in claim 1 wherein the Shore D hardness of the rubbery elastomer is in the range from 35 to 60.

* * * * *